US005947721A

United States Patent [19]

Yoshimura

[11] Patent Number: 5,947,721

[45] Date of Patent: Sep. 7, 1999

[54] RECYCLING APPARATUS FOR OBTAINING OIL FROM PLASTIC WASTE

[75] Inventor: Takeki Yoshimura, Nagano, Japan

[73] Assignees: MCC Co., Ltd.; Miwagumi Co.,, both of Nagano, Japan

[21] Appl. No.: 09/114,103

[22] Filed: Jul. 10, 1998

[51] Int. Cl.[6] ..... F27B 3/18

[52] U.S. Cl. ..... 432/161; 432/13; 126/343.5 A

[58] Field of Search ..... 432/13, 105, 161, 432/195, 219, 228, 106; 126/343.5 R, 343.5 A

[56] References Cited

U.S. PATENT DOCUMENTS

| | | | |
|---|---|---|---|
| 3,554,449 | 1/1971 | Currie | 126/343.5 A |
| 4,299,559 | 11/1981 | Shimizu et al. | 432/13 |
| 4,522,192 | 6/1985 | Miller | 126/343.5 A |
| 4,522,587 | 6/1985 | Miller | 126/343.5 A |
| 4,600,379 | 7/1986 | Elliott | 432/13 |
| 4,671,765 | 6/1987 | Tsai | 432/13 |
| 5,027,743 | 7/1991 | Ludwig | 126/343.5 A |
| 5,728,910 | 3/1998 | Matsubara et al. | 585/241 |

*Primary Examiner*—Teresa Walberg
*Assistant Examiner*—Gregory A. Wilson
*Attorney, Agent, or Firm*—Burgess, Ryan & Wayne

[57] ABSTRACT

A recycling apparatus for obtaining oil from waste plastic by thermal decomposition having a tank proper with a hopper to charge the waste plastic and multiple heating pipes disposed above one another which communicate with one another in the tank proper. The upper heating pipe is connected to a hot-air generator and the lower heating pipe to a flue duct leading to the outside atmosphere, thus dividing the tank proper into an upper thermal decomposition zone and a lower melting zone. As such, the recycling apparatus accomplishes the melting and thermal decomposition of the waste plastic in one tank. The recycling apparatus is simple and compact, provides substantial cost savings and ease of maintenance, and increases productivity and economy.

16 Claims, 6 Drawing Sheets

RECYCLING APPARATUS FOR OBTAINING OIL FROM PLASTIC WASTE

BACKGROUND OF THE INVENTION

This invention relates to a recycling apparatus for obtaining oil from waste plastics.

Conventional apparatus obtain heavy oil (fuel oil A equivalent) from waste plastics (high-polymeric waste) by thermal decomposition.

This type of conventional apparatus melts solid waste plastics (such as polyethylene, polyester and vinyl chloride) at a relatively low temperature of approximately 250° C. (or 70° C. for vinyl chloride) in a melting tank which thermally decomposes the molten waste plastics in a thermal decomposition tank heated to approximately 400° C. (or 170° C. for vinyl chloride). There is obtained the desired heavy oil by cooling the gas produced by the thermal decomposition. If solid waste plastics are directly charged into the thermal decomposition tank, the waste plastics will become carbonized. While this carbonization lowers recycling efficiency, the product of carbonization is not easy to dispose of. This is the reason why the melting tank to first melt solid waste plastic is provided.

However, conventional apparatuses of the type just mentioned have involved the following problems.

First, the need for the melting tank in addition to the thermal decomposition tank makes the whole assembly more intricate, larger, more costly and difficult to maintain.

Second, the longer time required for the processing of waste plastics lowers the productivity and increases the production cost of heavy oil.

Between the upper and lower parts where thermal decomposition and melting is effected there is an intermediate transition zone where waste plastic passes from a molten state to a thermally decomposed state.

This invention solves the aforementioned problems by use of conventional technologies.

Therefore, the object of this invention is to provide a simple and compact recycling apparatus for obtaining oil from waste plastics that provides substantial cost savings and ease of maintenance while offering higher productivity and greater economy.

SUMMARY OF THE INVENTION

To solve the above problems, a recycling apparatus for obtaining oil from waste plastic subjected to thermal decomposition under heat according to this invention comprises a tank proper having a hopper through which waste plastic is charged and multiple heating pipes disposed above one another and communicating with one another in the tank proper, with an upper heating pipe connected to a hot-air generator and a lower heating pipe connected to a flue duct leading to the outside atmosphere, thus dividing the tank proper into an upper zone where thermal decomposition takes place and a lower zone where melting takes place.

DETAILED DESCRIPTION OF THE INVENTION

Figure 1:
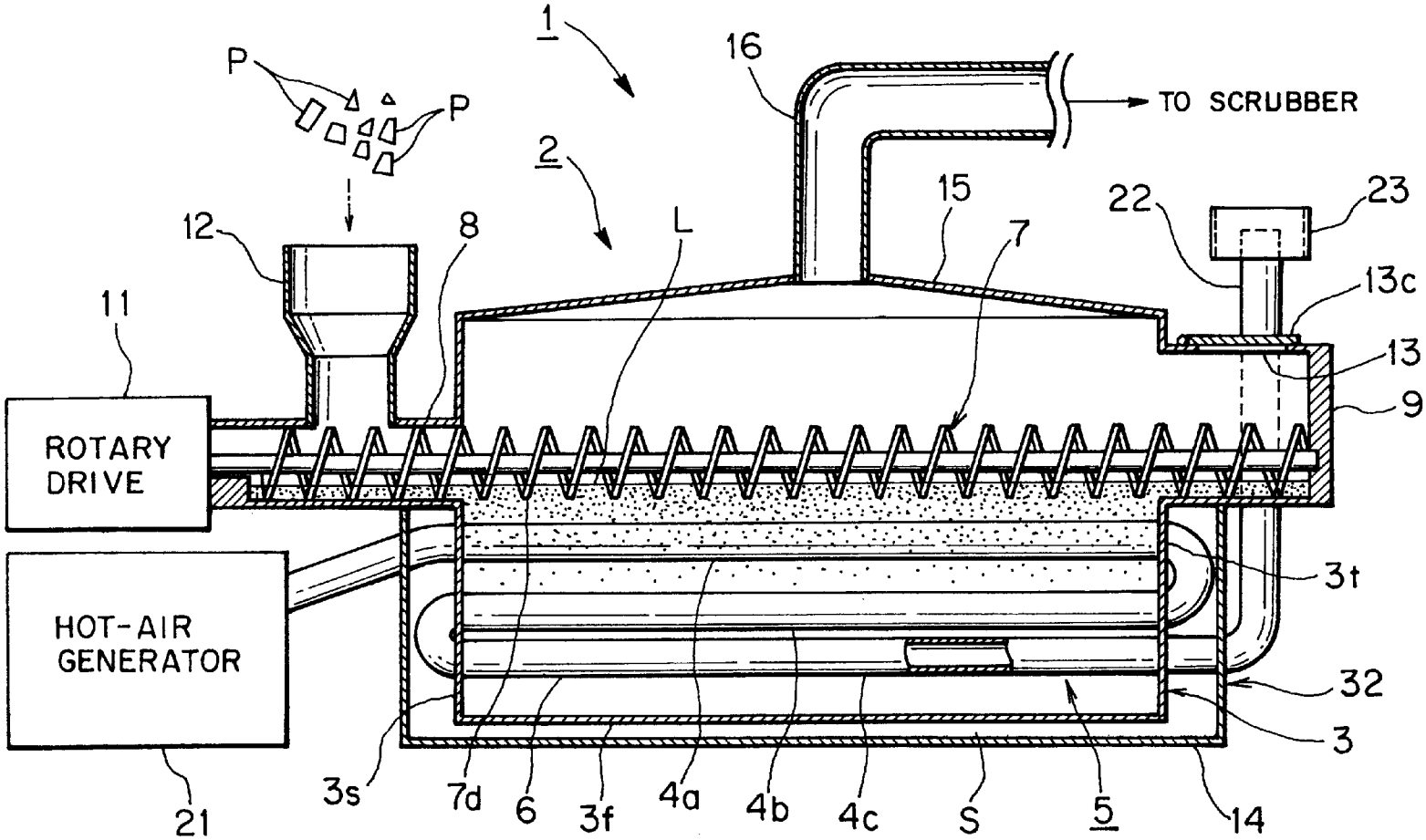
FIG. 1 is a cross-sectional side elevation of a thermal decomposition tank comprising the principal part of a first embodiment of the oil recycling apparatus according to this invention.

FIG. 1 shows the basic structure of an oil recycling apparatus according to this invention. As illustrated, multiple heating pipes are disposed above one another in a tank proper 3. While an upper heating pipe is connected to a hot-air generator 21, a lower heating pipe is connected to a flue duct 22 leading to the outside atmosphere.

This arrangement permits keeping the lower heating pipe at a lower temperature than the upper heating pipe. This arrangement further permits keeping the lower heating pipe at a temperature at which waste plastic melts (approximately 70° C. for vinyl chloride and approximately 250° C. for other plastics).

In FIG. 1, the uppermost heating pipe is connected to the hot-air generator 21 and lowermost heating pipe is connected to the flue duct 22. However, the heating pipes connected to the hot-air generator 21 and the flue duct 22 need not be the uppermost and lowermost ones. One each of the upper and lower heating pipes may be connected to the hot-air generator 21 and the flue duct 22 so that temperatures for melting and thermally decomposing waste temperatures for melting and thermally decomposing waste plastic are obtained in the tank proper 3.

The gas resulting from the thermal decomposition is converted into heavy oil in the subsequent neutralizing and cooling processes.

This invention overcomes the drawbacks with conventional technologies described earlier, permits designing simple and compact apparatus, and greatly increases the productivity and economy of the oil recycling process.

Embodiments

FIG. 1 shows an embodiment that has a hopper 12 into which waste plastic is charged mounted on the tank proper.

In this first embodiment, the tank proper has a smaller cross section in the lower part than in the upper part. The temperature of molten waste plastic L is maintained at a given level by applying heat from below even when the apparatus is out of operation. Therefore, the smaller bottom permits reducing the amount of heat required for maintaining the temperature of the molten waste plastic L at the desired level.

When the apparatus is in operation, the molten waste plastic ascends as its specific gravity decreases as the transition from a molten state to a thermally decomposed state proceeds. Therefore, the larger top allows for the expansion of the ascending molten waste plastic.

The tank proper of the first embodiment has a semicylindrical profile growing smaller in cross section from top to bottom, with semicircular end surfaces 3*s* and 3*t*.

The lower heating pipe 4*c* is set at a temperature that is required for melting waste plastic P, whereas the upper heating pipe 4*a* is set at a temperature that is required for thermally decomposing molten waste plastic L.

In the first embodiment, multiple heating pipes 4*a*, 4*b*, and 4*c* are straight segments of a continuous length of pipe 6 bent in a zigzag pattern. Hot air is supplied to the uppermost heating pipe 4*a* and discharged through the lowermost heating pipe 4*c*.

Figure 2:
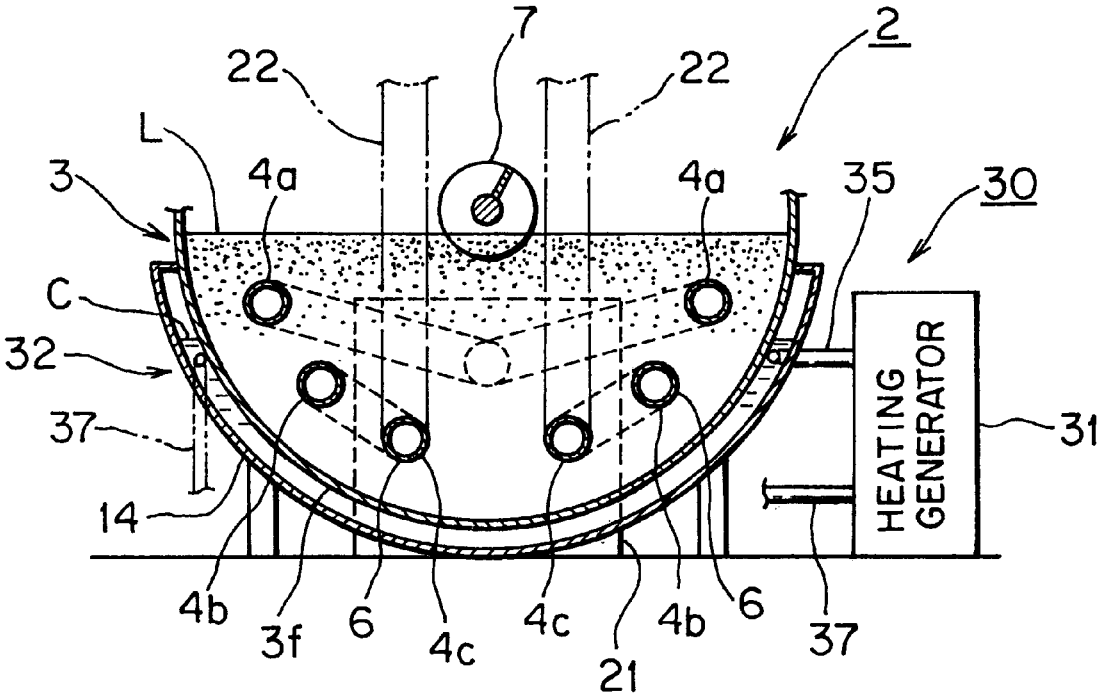
FIG. 2 is a cross-sectional front view of the thermal decomposition tank.

Although the embodiment shown in FIG. 2 has multiple continuous pipes 6 in each half of the cross section, only one continuous pipe may be provided in each half when the tank proper is small.

The first embodiment has a screw conveyor 7 that transports the waste plastic P from the hopper 12 from therebelow toward the opposite end to ensure smooth and uniform downward delivery and melting.

The screw conveyor 7 in the first embodiment disposed between a supply segment 8 and a foreign matter recovery segment 9 in the upper part of the tank proper so that the falling waste plastic P is transported while in contact with the cracked gas resulting from thermal decomposition. Therefore, the lower part 7*d* of the screw conveyor 7 is in contact with the thermally decomposed plastic L.

With the screw conveyor 7 thus disposed, the solid waste plastic P charged into the supply segment through the hopper 12 moves to the inner part of the tank proper and then downward. The lower heating pipe 4*c* is kept at a relatively low temperature heats and melts the waste plastic P falling from above.

When the level of molten waste plastic L increases and the upper surface thereof reaches the heating pipe 4*a* kept at a high temperature, the heating pipe 4*a* heats and gasifies the waste plastic by thermal decomposition.

On being cooled, the cracked gas is liquefied into heavy oil (fuel oil A equivalent).

The screw conveyor 7 carries carbides and other foreign matter floating on top of the molten waste plastic L to the foreign matter recovery segment 9 for recovery. The screw conveyor 7 also stirs and cleans the top surface of the waste plastic L and increases the generation efficiency of cracked gas.

Details of the first embodiment are described by reference to FIGS. 1 and 2. The screw conveyor 7 is turned by a rotary drive 11.

The integral supply segment 8 outwardly protrudes from the upper part of the end surface 3*s* of the tank proper 3, whereas the integral foreign matter recovery segment 9 outwardly protrudes from the upper part of the end surface 3*t*. Both ends of the screw conveyor 7 are respectively accommodated in the supply segment 8 and the foreign matter recovery segment 9.

The screw conveyor 7 is set so that the lower part 7*d* thereof is immersed in a bath of the molten waste plastic L.

The hopper 12 into which the solid waste plastic P is charged is disposed above the supply segment 8, whereas an outlet 13 through which the recovered foreign matter is removed is provided above the foreign matter recovery segment 9.

Reference numeral 13*c* designates a cover of the outlet 13.

The tank proper 3 is almost entirely enclosed within an outer plate 14, with a space S between the outer plate 14 and tank proper 3 serving as a heat insulating space 32 to which heat-retaining oil C is supplied from a heating device 31 described later. The space S between the outer surface 3*f* of the tank proper 3 and the outer plate 14 may be relatively small because only the heat-retaining oil C is filled therein. However, the space S between the end surfaces 3S and 3T and the outer plate 14 must be large enough to contain both the heat-retaining oil C and the curved portions of the continuous length of pipe 6 described later. Reference numeral 15 denotes a cover on top of the tank proper 3, with a duct 16 to recover the cracked gas connected to the highest point at the center thereof. The duct 16 is connected to a scrubber 52 described below.

A heating mechanism 5 is provided for the tank proper 3. The heating mechanism 5 has multiple horizontal heating pipes 4*a*, 4*b* and 4*c* disposed in the tank proper 3. The heating pipes 4*a*, 4*b* and 4*c* are equally spaced along the inner surface of the tank proper 3, preferably at intervals of 10 to 15 cm. The heating pipes 4*a*, 4*b* and 4*c* are multiple straight segments of a continuous length of pipe 6 that is bent in a zigzag pattern. The multiple straight segments of the continuous length of pipe 6 obtained by zigzagging the continuous length of pipe 6 are disposed in the tank proper 3, with the curved portions thereof placed in the space S between the outer plate 14 and the tank proper 3.

Although the embodiment shown in FIG. 2 has two continuous lengths of pipe 6 in each half of the cross section, the number of the continuous length of pipe in each half of the cross section is not specifically limited as stated earlier.

The open ends of the uppermost heating pipes 4*a* are connected to the hot-air generator 21, whereas the open ends of the lowermost heating pipes 4*c* are connected to the flue ducts 22 to each of which is connected a blower 23. Thus, the hot air supplied from the hot-air generator 21 to the uppermost heating pipes 4*a* passes through the intermediate heating pipes 4*b* to the lowermost heating pipes 4*c* from which it is discharged outside.

The temperature of the lower heating pipes 4*c* becomes gradually lower than the temperature of the upper heating pipes 4 as the hot air liberates heat when it passes through the continued length of pipe 6. Therefore, the diameter and length of the continued lengths of pipe 6 (the number of heating pipes 4*a*) and other conditions must be selected so that the temperature of the lower heating pipes 4*c* becomes high enough to melt the waste plastic P when the temperature of the uppermost heating pipes 4*a* reaches a temperature high enough to thermally decompose the molten waste plastic L.

A heat-resisting liquid glass (that becomes solid at room temperature) is coated on the outer surface of the heating pipes 4*a*, the inner surface of the tank proper 3, and the outer surface of the screw conveyor 7 that come in contact with the molten waste plastic L and the cracked gas. Being made of steel or other metal, the heating pipes 4*a*, tank proper 3 and screw conveyor 7 are vulnerable to corrosive attack. Particularly when the waste plastic is vinyl chloride, the hydrogen chloride generated by thermal decomposition rapidly corrodes and oxidizes metals.

Figure 3:
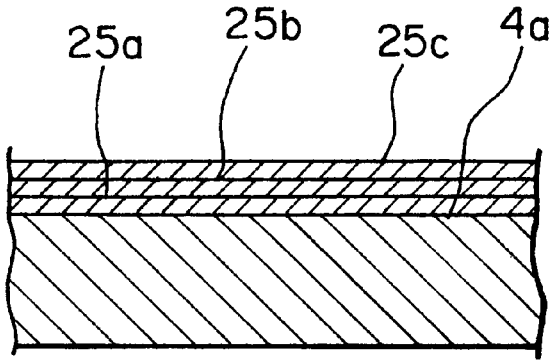
FIG. 3 is a partial cross-sectional view of a heating pipe in the thermal decomposition tank.

Therefore, the liquid glass 25*a* is coated on the surface of the heating pipes 4*a* and so on to impart adequate chemical resistance, corrosion resistance and durability. It is preferable to provide multilayered coatings by applying several layers of liquid glass shown as 25*a*, 25*b* and 25*c* on the surface of the heating pipes 4*a* and so on, as shown in FIG. 3.

Figure 5:
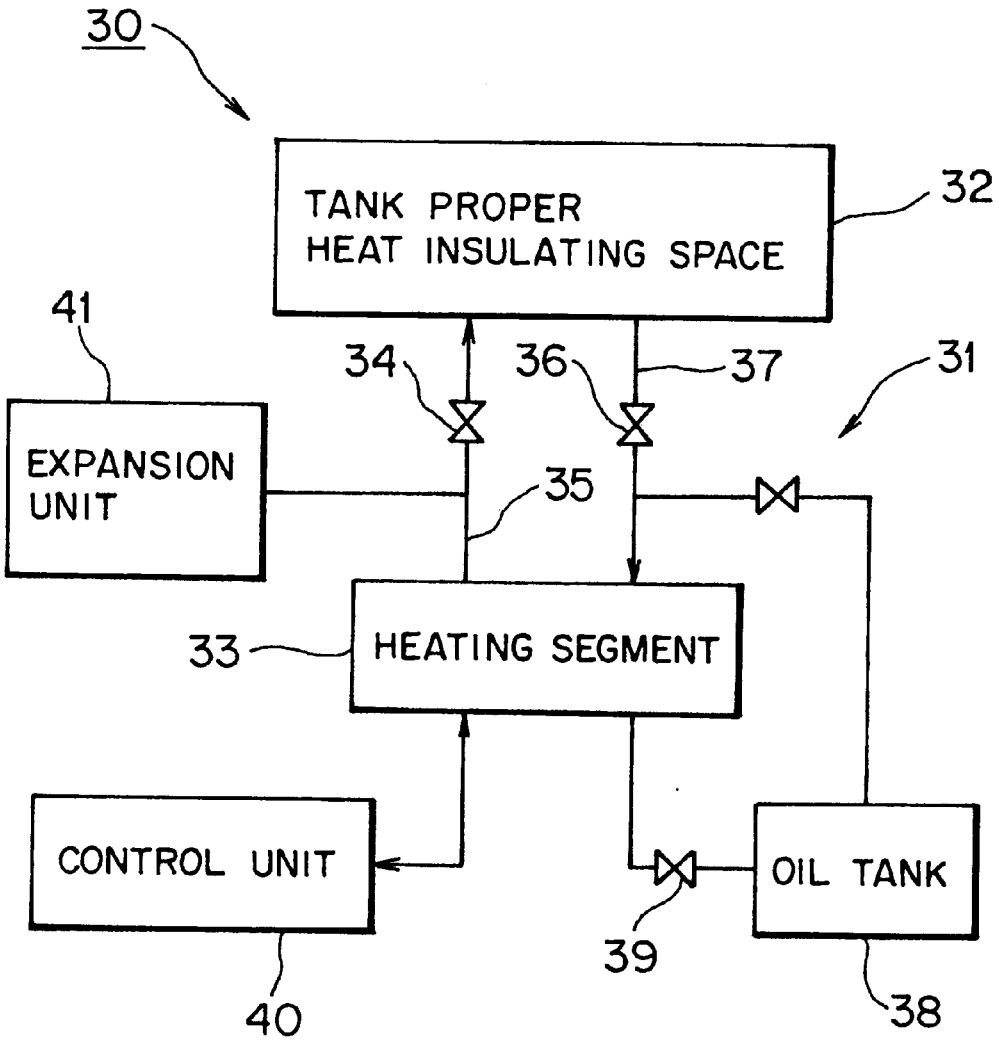
FIG. 5 is a block diagram of a heat-retaining device provided to the oil recycling apparatus.

Furthermore, a heat-retaining device 30 shown in FIG. 5 is attached to the thermal decomposition tank 2. The heat retaining device 30 has a heating device 31 which, in turn, has a heating segment 33. The heating segment 33 has a discharge port that is connected to one side of the upper part of the heat insulating space 32 mentioned earlier via piping 35 having a valve 34 as shown in FIGS. 2 and 5 and a suction port that is connected to the other side of the upper part of the heat insulating space 32 vial piping 37 having a valve 36. Thus, the heat-retaining oil C heated in the heating segment 33 is supplied through the piping 35 to the space S that constitutes the heat insulating space 32 between the outer plate 14 and the tank proper 3 and thence through the piping 37 back to the heating segment 33, thus forming a heating circulation circuit.

Reference numeral 38 designates an oil tank connected to the heating segment 33 via a valve 39, 40-a control unit that controls the operation and heating temperature of the heating segment 33 and 41 is an expansion unit that includes a function to liquefy the gasified heat-retaining oil.

Figure 4:
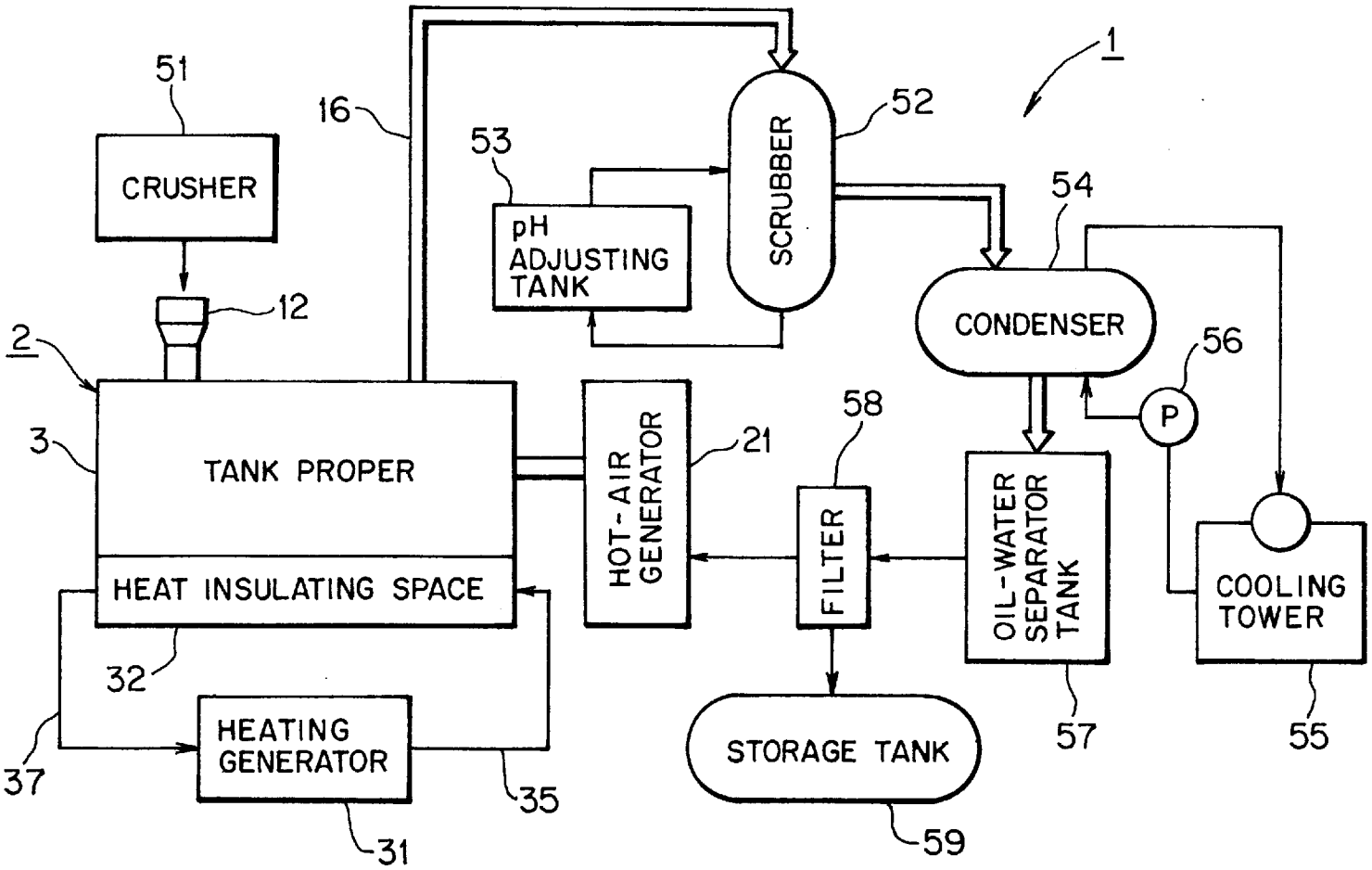
FIG. 4 is a block diagram showing the entire system of the oil recycling apparatus.

FIG. 4 shows the entire configuration of a typical oil recycling apparatus 1 having the thermal decomposition tank 2. In FIG. 4, reference numeral 51 designates a crusher that breaks large waste plastic into smaller pieces, 52 a scrubber that neutralizes hydrogen chloride gas, 53 a pH adjusting tank attached to the scrubber, 54 a condenser to liquefy the cracked gas, 55 a cooler (cooling tower) to provide water to cool the condenser 54, 56 a pump, 57 an oil-water separator tank to separate the obtained heavy oil from water, 58 a filter, and 59 a heavy oil storage tank.

The overall operations of the oil recycling apparatus 1 including the thermal decomposition tank 2 are described below by reference to the relevant drawings.

First, the hot-air generator 21 supplies hot air to the uppermost heating pipes 4*a* that are then heated to approximately 400° C. (or 170° C. for polyvinyl chloride). The lowermost heating pipes 4*c* are heated to approximately 250° C. (or 70° C. for polyvinyl chloride). The diameter and length of the continued lengths of pipe 6 (and the number of the heating pipes 4*a*) are selected so that the temperatures just mentioned are obtained. The hot air is then discharged outside via the flue ducts 22, with the help of the suction provided by the blower 23.

The solid waste plastic P (such as polyethylene, polyester and polyvinyl chloride) is charged into the hopper 12. The crusher 51 breaks larger pieces into smaller ones. The rotary drive 11 is actuated to turn the screw conveyor 7 that transports the solid waste plastic P from the hopper 12 to the inside of the tank proper 2. The quantity of the waste plastic P supplied to the tank proper 2 can be adjusted by controlling the rotation speed of the screw conveyor 7.

In the tank proper 2, the waste plastic P falls to the bottom thereof where it is heated and melted by the lowermost heating pipes 4*c* kept at a relatively low temperature. The molten waste plastic L is stored in the tank proper 2 and the top surface thereof rises as the quantity stored increases. When the rising top surface reaches the uppermost heating pipes 4*a* kept at a high temperature, the molten waste plastic L is thermally decomposed and gasified. The screw conveyor 7 transports carbides and other foreign matter floating on top of the molten waste plastic L to the foreign matter recovery segment 9. The screw conveyor 7 also stirs and cleans the top surface of the molten waste plastic L and increases the generation efficiency for cracked gas.

The cracked gas thus produced passes through the duct 16 to the scrubber 52 where the hydrogen chloride gas contained in the cracked gas is neutralized. The cracked gas then passes from the scrubber 52 to the condenser 54 where it is cooled and liquefied into heavy oil (fuel oil A equivalent). The condenser 54 is cooled by a cooling liquid supplied from the cooler 55. The obtained heavy oil is supplied to the oil-water separator tank 57 that separates water form the heavy oil. The filter 58 removes impurities from the heavy oil. The heavy oil thus obtained is stored in the storage tank 59. Part of the heavy oil is supplied to the hot-air generator 21 as a fuel.

When the oil recycling apparatus 1 is out of operation as during the night, the heat-retaining device 30 keeps the thermal decomposition tank 2 hot. The heating segment 33 heats the heat-retaining oil C to a temperature between 70 and 400° C. The heat-retaining oil C is then returned from the space S to the heating segment 33 through the piping 37. This keeps the molten waste plastic L remaining in the tank proper 3 warm, thereby significantly reducing the start-up time.

Figure 6:
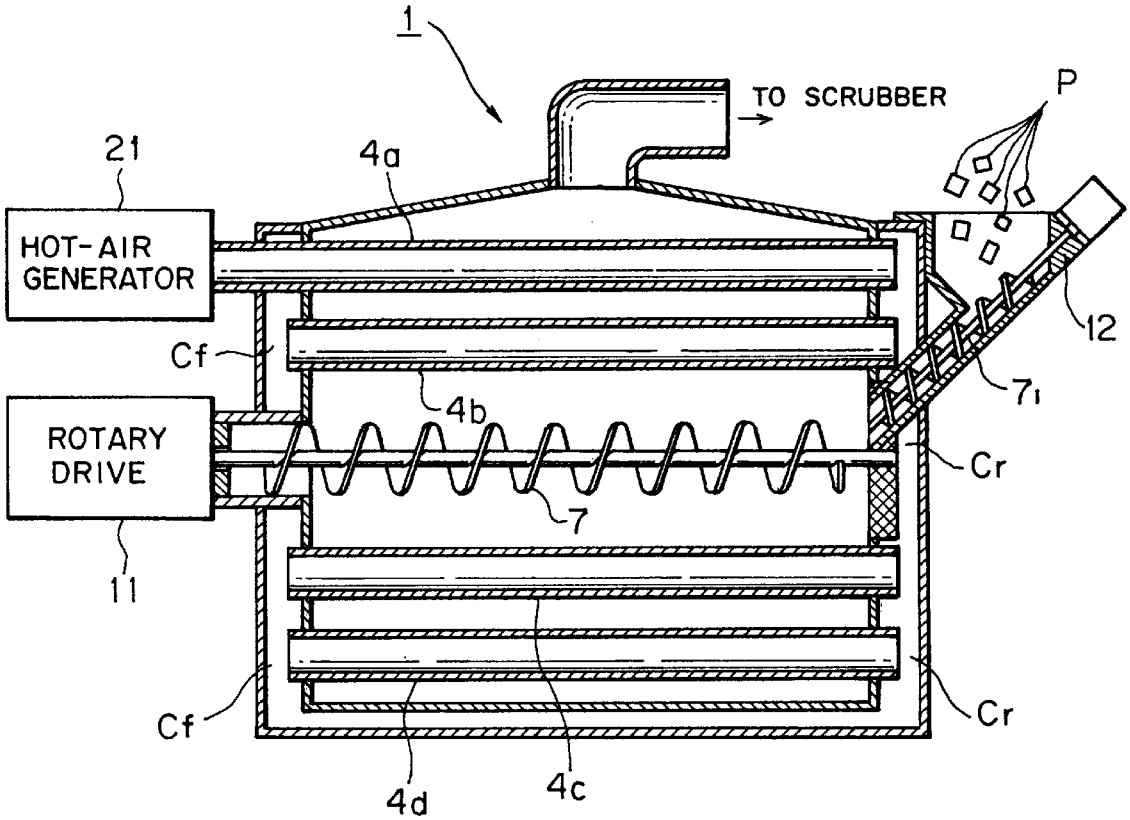
FIG. 6 is a cross-sectional side elevation of a thermal decomposition tank that comprises the principal part of a second embodiment of the oil recycling apparatus according to this invention.

In the second embodiment, the hopper 12 is connected to one side of the tank proper 3, as shown in FIG. 6. This design permits charging the waste plastic P directly into the thermal decomposition zone of the tank proper 3—unlike the first embodiment. While the hopper 12 in FIG. 6 is diagonally connected to the side of the tank proper 3, the design of the second embodiment is by no means limited thereto. For example, the hopper 12 may be connected horizontally to the tank proper, with the connecting end thereof cut squarely. In the second embodiment, the level of the molten waste plastic L rises up to the middle of the hopper 12. A screw conveyor 71 extending from the far end of the hopper 12 to the tank proper 3 (diagonally in FIG. 6) may be provided to facilitate the quick feed of the charged waste plastic P into the tank proper 3.

In the second embodiment, the waste plastic is charged from the side of the tank proper 3 to the melting zone thereof. The screw conveyor 7 is provided to move the charged waste plastic P to the inner part of the tank proper, as in the embodiment shown in FIG. 1. The screw conveyor 7 in the second embodiment extends from near the point where the connected end of the hopper 12 opens and the opposite side thereof.

Figure 7:
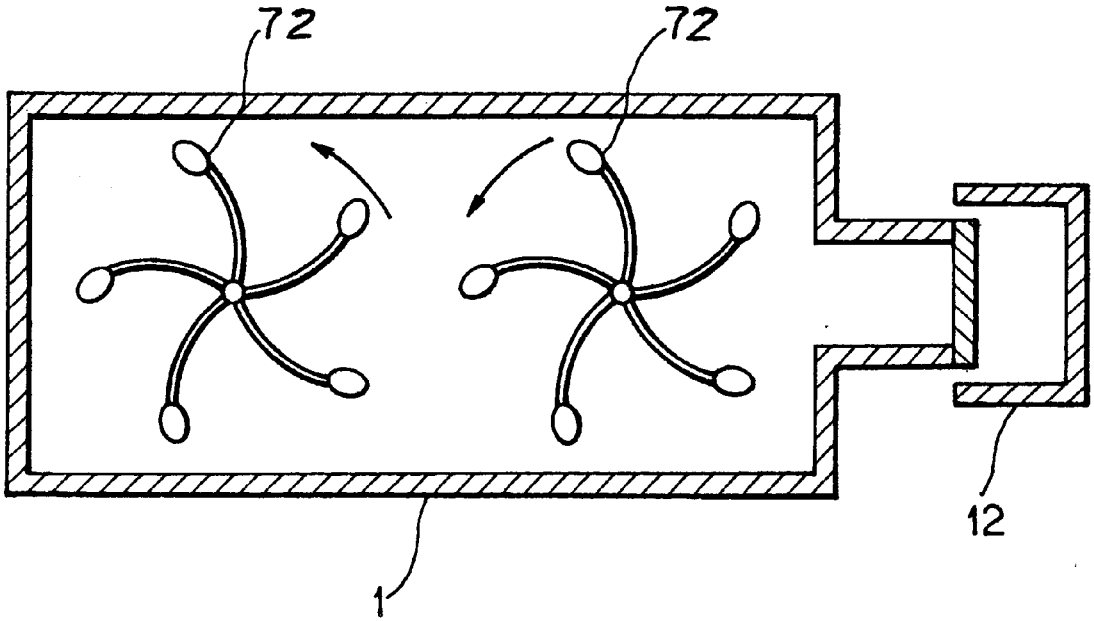
FIG. 7 is a cross-sectional top view of rotor blades in the tank proper of the second embodiment.

In place of the screw conveyor 7, rotor blades 72 that turn near the point where the hopper 12 is connected to the tank proper 3 may be provided as shown in FIG. 7, with each blade being concave in the direction of rotation. The rotor blades 72 spread the charged waste plastic P over the entirety of the melting zone of the tank proper 3.

In the second embodiment, the upper heating pipes at higher temperature and the lower heating pipes at lower temperature are connected by a front communicating space Cf and a rear communicating space Cr at the front and rear sides of the tank proper 3, shut off from the outside, as shown in FIG. 6. The inlets and outlets of the heating pipes 4*a*, 4*b* and 4*c* open in the front communicating space Cf and the rear communicating space Cr.

Thus, the hot air travels from the upper heating pipe 4*a*, through the rear communicating space Cr, heating pipe 4*b*, front communicating space Cf, heating pipes 4*c* and 4*d*, and rear communicating space Cr, to the flue, with the temperature of the hot air falling as the travel thereof proceeds.

Being similar to those of the first embodiment, coating of liquid glass on the outer surface of the heating pipes 4*a* and the internal portions of the tank proper 3 as described in relation to FIG. 1 and the overall structure and operations of the oil recycling apparatus 1 will not be described here.

Generally, thermal decomposition of molten plastic L consumes more energy than melting the solid plastic P.

In a third embodiment, accordingly, the upper heating pipe 4*a* in the thermal decomposition zone has a larger diameter than the heating pipes 4*b* and 4*c* in the melting zone.

It is also possible to achieve a quick and smooth transition from a molten state to a thermally decomposed state by selecting a pipe of an intermediate diameter as the heating pipe 4*b* disposed between the heating pipe 4*a* of a larger diameter and the heating pipes 4*c* and 4*d* of smaller diameters.

Furthermore, the upper heating pipe 4*a* in the thermal decomposition zone may be horizontally zigzagged depending on the thermal capacity required.

Using a larger diameter pipe as the heating pipe 4*a* in the thermal decomposition zone or zigzagging it permits achieving quick and uniform distribution of heat radiated from the heating pipe 4*a*, particularly when the tank profile is flared upward as in the first embodiment.

The plastic recycling apparatus according to this invention has the following beneficial effects:

(1) The thermal decomposition tank doubling as the melting tank is conducive to the overall simplification and size reduction of the apparatus and the achievement of substantial cost savings and ease of maintenance.

(2) Processing of waste plastics at an increased speed greatly increases the productivity and economy in heavy oil production.

(3) Provision of the screw conveyor in the tank proper, as in the first and second embodiments, permits uniform distribution and efficient melting and thermal decomposition of waste plastics in the tank proper. Particularly when the screw conveyor is disposed in the upper part of the tank proper as in the first embodiment, stirring and cleaning of the top surface of the molten waste plastic increases the generation efficiency for cracked gas.

What is claimed is:

1. A recycling apparatus for obtaining oil from waste plastic by thermal decomposition comprising: a tank proper having a hopper to charge waste plastic; multiple heating pipes disposed above one another and communicating with one another in the tank proper, the upper heating pipe being connected to a hot-air generator and the lower heating pipe being connected to a flue duct leading to the outside atmosphere, thus dividing the tank proper into an upper thermal decomposition zone and a lower melting zone.

2. The recycling apparatus according to claim 1 wherein the tank proper is constricted downward.

3. The recycling apparatus according to claim 1 wherein the hopper to charge the waste plastic is arranged to provide waste plastic to a top portion of the tank proper.

4. The recycling apparatus according to claim 2 having a screw conveyor to transport the charged waste plastic from below the hopper to another area.

5. The recycling apparatus according to claim 1 wherein the hopper to charge the waste plastic is arranged to communicate with one side of the tank proper.

6. The recycling apparatus according to claim 4 having a screw conveyor arranged to transport the charged waste plastic from the hopper to the inside of the tank proper.

7. The recycling apparatus according to claim 5 having a screw conveyor arranged to transport the charged waste plastic from near a point on the side where the connected end of the hopper opens toward an opposite side thereof.

8. The recycling apparatus according to claim 2 having a rotary blade means to transport the waste plastic from near a point where the connected end of the hopper opens to the inside of the tank proper.

9. The recycling apparatus according to claim 1 wherein the multiple heating pipes in the tank proper are formed by zigzagging a continuous length of pipe into multiple straight segments one above the other.

10. The recycling apparatus according to claim 1 having front and rear communicating spaces shut off from the outside and accommodating entry and exit ends of the heating pipes.

11. The recycling apparatus according to claim 1 having a flue duct connected to a scrubber to neutralize hydrogen chloride gas, the scrubber in fluid communication with a condenser and the condenser in communication with an oil-water separator tank.

12. The recycling apparatus according to claim 10 wherein the oil-water separator tank is in communication with a storage tank and the hot-air generator.

13. The recycling apparatus according to claim 1 wherein metal surfaces which contact cracked gas resulting from thermal decomposition are coated with a heat-resisting glass which becomes liquid at elevated temperatures.

14. The recycling apparatus according to claim 12 wherein the coating is formed by applying glass in layers.

15. The recycling apparatus according to claim 1 wherein the diameter of the heating pipe in the upper thermal decomposition zone is larger than the diameter of the heating pipes in other zones.

16. The recycling apparatus according to claim 1 wherein the heating pipe in the upper thermal decomposition zone is horizontally zigzagged.

* * * * *